US007258631B2

(12) United States Patent
Galloway et al.

(10) Patent No.: US 7,258,631 B2
(45) **Date of Patent: *Aug. 21, 2007**

(54) GOLF CLUB HEAD

(75) Inventors: J. Andrew Galloway, Escondido, CA (US); Alan Hocknell, Encinitas, CA (US); Matthew T. Cackett, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/530,836

(22) Filed: Sep. 11, 2006

(65) Prior Publication Data

US 2007/0004530 A1 Jan. 4, 2007

Related U.S. Application Data

(62) Division of application No. 10/710,215, filed on Jun. 25, 2004, now Pat. No. 7,163,470.

(51) Int. Cl.
*A63B 53/04* (2006.01)
*A63B 53/06* (2006.01)

(52) U.S. Cl. ..... 473/345; 473/346; 473/348

(58) Field of Classification Search ..... None
See application file for complete search history.

(56) References Cited

U.S. PATENT DOCUMENTS

| | | | | | |
|---|---|---|---|---|---|
| 4,681,321 | A * | 7/1987 | Chen et al. | ..... | 473/332 |
| 4,930,781 | A * | 6/1990 | Allen | ..... | 473/346 |
| 5,000,454 | A * | 3/1991 | Soda | ..... | 473/346 |
| 5,295,689 | A * | 3/1994 | Lundberg | ..... | 473/346 |
| 5,669,829 | A * | 9/1997 | Lin | ..... | 473/346 |
| 5,839,975 | A * | 11/1998 | Lundberg | ..... | 473/346 |
| 6,299,547 | B1 * | 10/2001 | Kosmatka | ..... | 473/329 |
| 7,163,470 | B2 * | 1/2007 | Galloway et al. | ..... | 473/342 |

* cited by examiner

*Primary Examiner*—Eugene Kim
*Assistant Examiner*—Alvin A Hunter
(74) *Attorney, Agent, or Firm*—Michael A. Catania; Elaine H. Lo

(57) ABSTRACT

A golf club head (20) having optimized inertial properties and center of gravity is disclosed. The golf club head (20) preferably has a volume between 300 cubic centimeters and 500 cubic centimeters. The golf club head (20) has a center of gravity located less than 1.7 inches from an exterior surface of a front wall (30). The positioning of the center of gravity of the golf club head (20) and the optimized inertial properties provide the golf club with greater ball spin robustness and better performance.

9 Claims, 12 Drawing Sheets

GOLF CLUB HEAD

CROSS REFERENCES TO RELATED APPLICATIONS

The present application is a Divisional Application of U.S. patent application Ser. No. 10/710,215 filed on Jun. 25, 2004 now U.S. Pat. No. 7,163,470.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head designed with optimized inertial properties and center of mass relative through the center of gravity.

2. Description of the Related Art

As driver golf club heads have increased in volume (>300 cubic centimeters) their moments of inertia have also increased, providing greater forgiveness for off-center hits. The conventional method for enlargement of golf club heads was to maximize the spatial distribution of mass in all three orthogonal orientations. Although this approach was effective in increasing the moments of inertia of the golf club heads, it also resulted in the center of gravity of the golf club head being positioned substantially rearward from the front face of the golf club head.

As the center of gravity is positioned further rearward from the front face, deleterious effects result for shots struck off-center from the sweet spot of the golf club head. Increased gear effect is the main cause of the deleterious effects. For heel-ward or toe-ward off-center hits, the increased gear effect can cause increased side-spin, which increases dispersion, reduces distance and reduces robustness of ball flight. For off-center hits above the sweet spot, the increased gear effect causes reduced backspin, which can cause an undesirable trajectory having insufficient carry length or time of flight, which in turn can result in reduced distance and reduced robustness.

In addition, the same conventional golf club head designs are limited with regard to the maximum face area, both physical and practical limitations. The physical limitation is due to the golf club head having insufficient mass to both increase the length and width of the golf club head and also to increase the face size without exceeding the upper range of the preferred total golf club head mass. Such mass distributions are dependent on minimum wall thickness values required to achieve acceptable in-service durability.

The practical limitation is that as the face size is increased, hit locations in certain regions around the face perimeter will yield an unsatisfactory ball flight due to the aforementioned deleterious effects, which are accentuated for larger faces. The deleterious effects increase in a non-linear manner as the distance from the face center increases. Thus the incremental face area gained by increasing face size will be subject to more extreme deleterious effects. This limits the practical length of the club, because probable hit distribution across the surface of the face broadens as the club length increases. As a result a longer club will yield a larger percentage of hits in the perimeter regions of the face where the deleterious effects occur. This offsets the otherwise beneficial effect of increased head speed. As club length increases, head speed increases up to a length of approximately 52 inches, at which point aerodynamic and biomechanical effects offset the length effect.

Further, conventional head designs having a center of gravity positioned substantially rearward from the face are subject to significant dynamic loft effects, which can be undesirable. Dynamic loft increases with head speed, so that golfers with higher head speeds experience more dynamic loft than those with slower swing speeds. This is opposite of what is desired as higher head speeds generally require less loft, otherwise excess backspin will be generated, which negatively affects trajectory and performance.

One invention that addresses center of gravity depth is set forth in U.S. Pat. No. 6,344,002 to Kajita for a Wood Club Head. The Kajita invention discloses a golf club head with a center of gravity not more than 30 mm (1.18 inches) from the face. However, the Kajita invention does not address a high moment of inertia about the horizontal axis.

U.S. Pat. No. 6,146,571 to Vincent, et. al., discloses a method of manufacturing a golf club head wherein the walls are obtained by injecting a material such as plastic over an insert affixed to a meltable core. The core has a melt point lower than that of the injectable plastic material so that once the core is removed, an inner volume is maintained to form the inner cavity. The insert may comprise a resistance element for reinforcing the internal portion of the front wall of the shell upon removal of the core where the reinforcement element is comprised of aluminum with a laterally extending portion comprised of steel.

U.S. Pat. No. 6,149,534 to Peters, et al., discloses a golf club head having upper and lower metal engagement surfaces formed along a single plane interface wherein the metal of the lower surface is heavier and more dense than the metal of the upper surface.

U.S. Pat. Nos. 5,570,886 and 5,547,427 to Rigal, et al., disclose a golf club head of molded thermoplastic having a striking face defined by an impact-resistant metallic sealing element. The sealing element defines a front wall of the striking surface of the club head and extends upward and along the side of the impact surface to form a neck for attachment of the shaft to the club head. The sealing element preferably being between 2.5 mm and 5 mm in thickness.

U.S. Pat. No. 5,425,538 to Vincent, et al., discloses a hollow golf club head having a steel shell and a composite striking surface composed of a number of stacked woven webs of fiber.

U.S. Pat. No. 5,377,986 to Viollaz, et al., discloses a golf club head having a body composed of a series of metal plates and a hitting plate comprised of plastic or composite material wherein the hitting plate is imparted with a forwardly convex shape. Additionally, U.S. Pat. No. 5,310,185 to Viollaz, et al., discloses a hollow golf club head having a body composed of a series of metal plates, a metal support plate being located on the front hitting surface to which a hitting plate comprised of plastic or composite is attached. The metal support plate has a forwardly convex front plate associated with a forwardly convex rear plate of the hitting plate thereby forming a forwardly convex hitting surface.

U.S. Pat. No. 5,106,094 to Desboilles, et al., discloses a golf club head having a metal striking face plate wherein the striking face plate is a separate unit attached to the golf club head with a quantity of filler material in the interior portion of the club head.

U.S. Pat. No. 4,568,088 to Kurahashi discloses a wooden golf club head body reinforced by a mixture of wood-plastic composite material. The wood-plastic composite material being unevenly distributed such that a higher density in the range of between 5 mm and 15 mm lies adjacent to and extends substantially parallel with the front face of the club head.

U.S. Pat. No. 4,021,047 to Mader discloses a golf club wherein the sole plate, face plate, heel, toe and hosel portions are formed as a unitary cast metal piece and wherein a wood or composite crown is attached to this unitary piece thereby forming a hollow chamber in the club head.

U.S. Pat. No. 5,624,331 to Lo, et al. discloses a hollow metal golf club head where the metal casing of the head is composed of at least two openings. The head also contains a composite material disposed within the head where a portion of the composite material is located in the openings of the golf club head casing.

U.S. Pat. No. 1,167,387 to Daniel discloses a hollow golf club head wherein the shell body is comprised of metal such as aluminum alloy and the face plate is comprised of a hard wood such as beech, persimmon or the like. The face plate is aligned such that the wood grain presents endwise at the striking plate.

U.S. Pat. No. 3,692,306 to Glover discloses a golf club head having a bracket with sole and striking plates formed integrally thereon. At least one of the plates has an embedded elongate tube for securing a removably adjustable weight means.

U.S. Pat. No. 5,410,798 to Lo discloses a method of manufacturing a composite golf club head using a metal casing to which a laminated member is inserted. A sheet of composite material is subsequently layered over the openings of the laminated member and metal casing to close off the openings in the top of both. An expansible pocket is then inserted into the hollow laminated member comprising sodium nitrite, ammonium chloride and water causing the member to attach integrally to the metal casing when the head is placed into a mold and heated.

U.S. Pat. No. 4,877,249 to Thompson discloses a wood golf club head embodying a laminated upper surface and metallic sole surface having a keel. In order to reinforce the laminations and to keep the body from delaminating upon impact with an unusually hard object, a bolt is inserted through the crown of the club head where it is connected to the sole plate at the keel and tightened to compress the laminations.

U.S. Pat. No. 3,897,066 to Belmont discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

U.S. Pat. No. 2,750,194 to Clark discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

U.S. Pat. No. 5,193,811 to Okumoto, et al., discloses a wood type club head body comprised primarily of a synthetic resin and a metallic sole plate. The metallic sole plate has on its surface for bonding with the head body integrally formed members comprising a hosel on the heel side, weights on the toe and rear sides and a beam connecting the weights and hosel. Additionally, U.S. Pat. No. 5,516,107 to Okumoto, et al., discloses a golf club head having an outer shell, preferably comprised of synthetic resin, and metal weight member/s located on the interior of the club head. A foamable material is injected into the hollow interior of the club to form the core. Once the foamable material has been injected and the sole plate is attached, the club head is heated to cause the foamable material to expand thus holding the weight member/s in position in recess/es located in toe, heel and/or back side regions by pushing the weight member into the inner surface of the outer shell.

U.S. Pat. No. 4,872,685 to Sun discloses a wood type golf club head wherein a female unit is mated with a male unit to form a unitary golf club head. The female unit comprises the upper portion of the golf club head and is preferably composed of plastic, alloy, or wood. The male unit includes the structural portions of sole plate; a face insert consists of the striking plate and weighting elements. The male unit has a substantially greater weight being preferably composed of a light metal alloy. The units are mated or held together by bonding and or mechanical means.

U.S. Pat. No. 5,398,935 to Katayama discloses a wood golf club head having a striking face wherein the height of the striking face at a toe end of the golf club head is nearly equal to or greater than the height of the striking face at the center of the club head.

U.S. Pat. No. 1,780,625 to Mattern discloses a club head with a rear portion composed of a light-weight metal such as magnesium. U.S. Pat. No. 1,638,916 to Butchart discloses a golf club with a balancing member composed of persimmon or a similar wood material, and a shell-like body composed of aluminum attached to the balancing member.

Anderson, U.S. Pat. Nos. 5,024,437, 5,094,383, 5,255,918, 5,261,663 and 5,261,664 disclose a golf club head having a full body composed of a cast metal material and a face insert composed of a hot forged metal material.

Viste, U.S. Pat. No. 5,282,624 discloses a golf club head with a cast metal body and a forged steel face insert with grooves on the exterior surface and the interior surface of the face insert and having a thickness of 3 mm.

Rogers, U.S. Pat. No. 3,970,236, discloses an iron club head with a formed metal face plate insert fusion bonded to a cast iron body.

Aizawa, U.S. Pat. No. 5,242,168 discloses a golf club head having a fiber reinforced resin body with a thin metallic film layer.

Yamada, U.S. Pat. No. 4,535,990 discloses a golf club head having a fiber reinforced resin body with a face insert composed of a polycarbonate or like material.

Aizawa et al., U.S. Pat. No. 5,465,968 discloses a golf club head having a fiber reinforced resin body with a beryllium face plate.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. Complete descriptions of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e, which measures club face COR. This USGA test procedure, as well as procedures like it, may be used to measure club face COR.

BRIEF SUMMARY OF THE INVENTION

The present invention is generally directed to a golf club head that has improved mass distribution and optimized moments of inertia Izz, Iyy, and center of gravity relative to Ixx for a preferred combination of principle inertias and center of gravity.

The golf club head of the present invention provides increased distance and straightness for off-center hits, more stable feel and increased ball flight robustness. The positioning of the center of gravity near the front wall reduces the gear effect, which reduces side spin, dispersion and shot curvature resulting in a more consistent ball flight, improved accuracy and increased distance.

In accordance with the present invention, a golf club includes a body and a striking plate insert. The body has a crown, a sole, and a hollow interior. The striking plate insert is attached to the body and is composed of a material that has a density greater than that of the body. The golf club head further includes a weighting member attached to the body and providing weighting at least at a rear portion of the body. The golf club head has a center of gravity located less than approximately 1.7 inches from an exterior surface of a front wall and robustness efficiency parameter of less than approximately 0.410, the robustness is determined by the following equation:

$$REP = \left[\frac{I_{xx}}{(I_{yy} + 1.7(I_{zz}))}\right] * \frac{Dcg}{Rball}$$

where Dcg is the distance from the face impact to the club head center of gravity. Rball is simply the radius of the golf ball, which is set by the rules of golf. Ixx is the inertia about a fore/aft axis through the center of gravity. Izz is the club head inertia about a vertical axis through the center of gravity. Iyy is the club head inertia about an axis in the heel to toe direction through the center of gravity.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
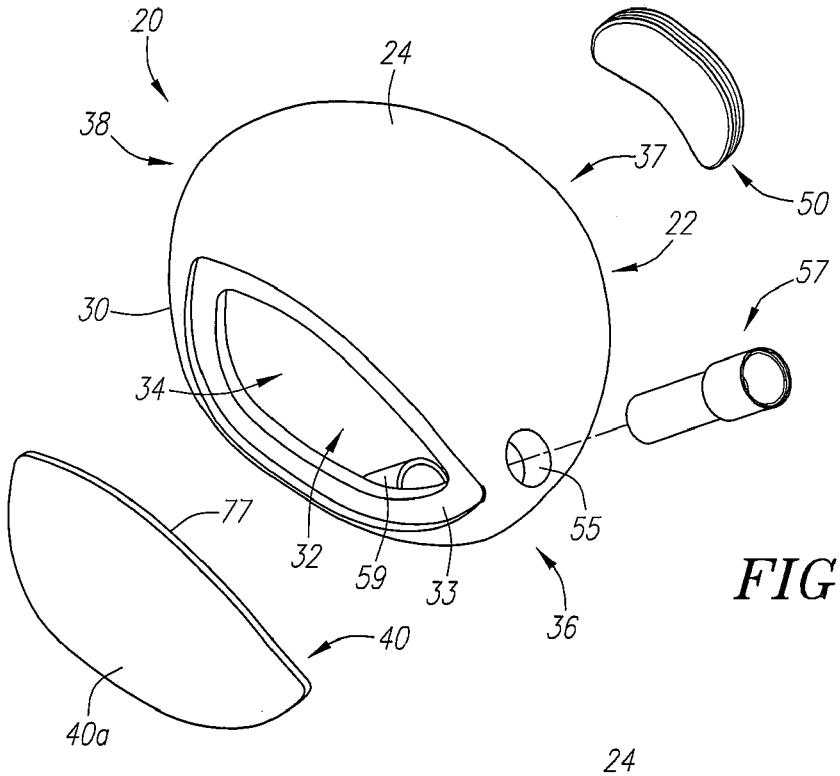
FIG. 1 is an exploded top perspective view of a golf club according to the first embodiment of the present invention.
Figure 2:
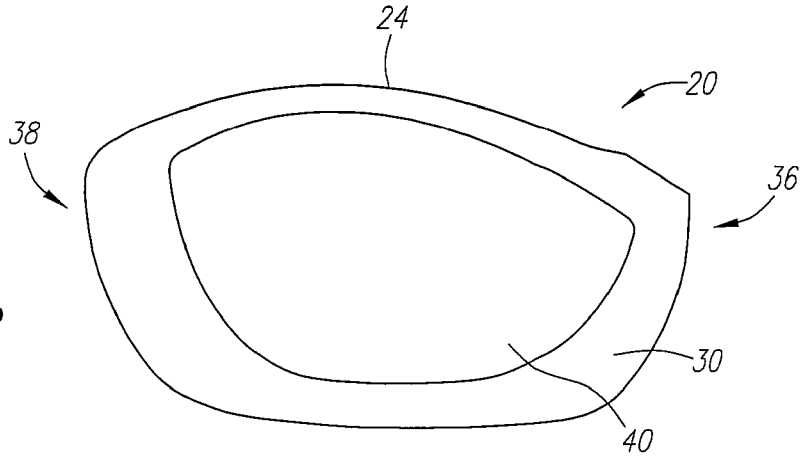
FIG. 2 is a front view of a golf club head of FIG. 1.

The present invention is generally directed to a golf club head that has a center of gravity positioned relatively close to a striking plate of the golf club head and a relatively high moment of inertia Iyy and Izz about the center of gravity of the golf club head. A preferred embodiment of the golf club head of the present invention is illustrated in FIGS. 1-10. Alternative embodiments of the present invention are illustrated in FIGS. 11-18. Although five embodiments are illustrated, those skilled in the pertinent art will recognize from this disclosure that other embodiments of the golf club head of the present invention are possible without departing from the scope and spirit of the present invention.

The golf club head of the present invention has discretionary mass located along the fore and aft portions of the club head, with the remainder of the club head being composed of a lightweight or lower density material. This improved mass distribution provides the golf club head with better inertial properties for back spin and sidespin optimization for variation of impact location on the club face.

A golf club head of the present invention is generally designated 20. The golf club head 20 has a body 22, which includes a crown 24, a sole 26, a ribbon 28, a front wall 30 and a hollow interior 34. The golf club head 20 has a heel end 36, a toe end 38, and an aft end 37.

The golf club head 20, when designed as a driver, preferably has a volume from 200 cubic centimeters to 600 cubic centimeters, more preferably from 300 cubic centimeters to 500 cubic centimeters, and most preferably from 350 cubic centimeters to 480 cubic centimeters. The volume of the golf club head 20 will also vary between fairway woods (preferably ranging from 3-woods to eleven woods) with smaller volumes than drivers. The golf club head 20 preferably has a mass no more than 225 grams, and most preferably a mass of 180 to 215 grams.

As shown in FIGS. 1-10, in one embodiment of the golf club head 20, the front wall 30 has an opening 32 and preferably a recessed portion 33. A striking plate insert 40 is disposed within the opening 32. The ribbon 28 of the body 22 has an aft-recess 52 located opposite of the striking plate insert 40, and a rear weighting member 50 is disposed within the aft-recess 52. The body 22 is preferably composed of a non-metal material, preferably a composite material such as a continuous fiber pre-preg material (including thermosetting materials or a thermoplastic materials for the resin). Other materials for the body 22 include thermosetting materials or thermoplastic materials such as injectable plastics. The body 22 is preferably manufactured through bladder-molding, resin transfer molding, resin infusion, injection molding, compression molding, or a similar process. Alternatively, the body 22 may be composed of a lightweight metallic material, such as magnesium alloys, aluminum alloys, magnesium, aluminum or other low density metals.

The striking plate insert 40 is attached to the body 22 over the opening 32 of the front wall 30. Preferably the striking plate insert 40 is positioned over and attached to the recessed portion 33 of the front wall 30.

The striking plate insert 40 is preferably composed of a formed metal material. However, the striking plate insert 40 may also be composed of a machined metal material, a forged metal material, a cast metal material or the like. The striking plate insert 40 preferably is composed of a titanium or steel material. Titanium materials suitable for the striking plate insert 40 include pure titanium and titanium alloys. Other metals for the striking plate insert 40 include high strength steel alloy metals and amorphous metals. The exterior surface 40*a* of the striking plate insert 40 typically has a plurality of scorelines thereon, not shown.

The striking plate insert 40 has uniform thickness in the range from 0.040 inch to 0.250 inch, more preferably a in the range from 0.080 inch to 0.120 inch, and is most preferably 0.108 inch for a titanium alloy striking plate insert 40 and 0.090 inch for a stainless steel striking plate insert 40.

The striking plate insert 40 is preferably co-molded with the body 22 or press-fitted into the opening 32 subsequent to fabrication of the body 22. In another attachment process, the body 22 is first bladder molded and then the striking plate insert 40 is bonded to the recessed portion 33 of the front wall 30 using an adhesive. The adhesive is placed on the exterior surface of the recessed portion 33. Such adhesives include thermosetting adhesives in a liquid or a film medium. In yet another attachment process, the body 22 is first bladder molded and then the striking plate insert 40 is mechanically secured to the body 22. Those skilled in the pertinent art will recognize that other methods for attachment of the striking plate insert 40 to the body 22 may be composed without departing from the scope and spirit of the present invention.

As mentioned above, the non-metallic body 22 is preferably composed of a plurality of plies of pre-preg, typically six or seven plies (preferably ranging from three plies to twenty plies) such as disclosed in U.S. Pat. No. 6,248,025, entitled Composite Golf Head And Method Of Manufacturing, which is hereby incorporated by reference in its entirety. In such an embodiment, the crown 24, the sole 26 and the ribbon 28 preferably range in thickness from 0.010 inch to 0.100 inch, more preferably from 0.025 inch to 0.070 inch, even more preferably from 0.028 inch to 0.040 inch, and most preferably have a thickness of 0.033 inch. The front wall 30 preferably has a thickness greater than the thickness of the crown 24, sole 26 or ribbon 28. The thickness of the front wall preferably ranges from 0.030 to 0.150 inch, more preferably from 0.050 inch to 0.100 inch, even more preferably from 0.070 inch to 0.090 inch, and most preferably the front wall 30 has a thickness of 0.080 inch.

Figure 6:
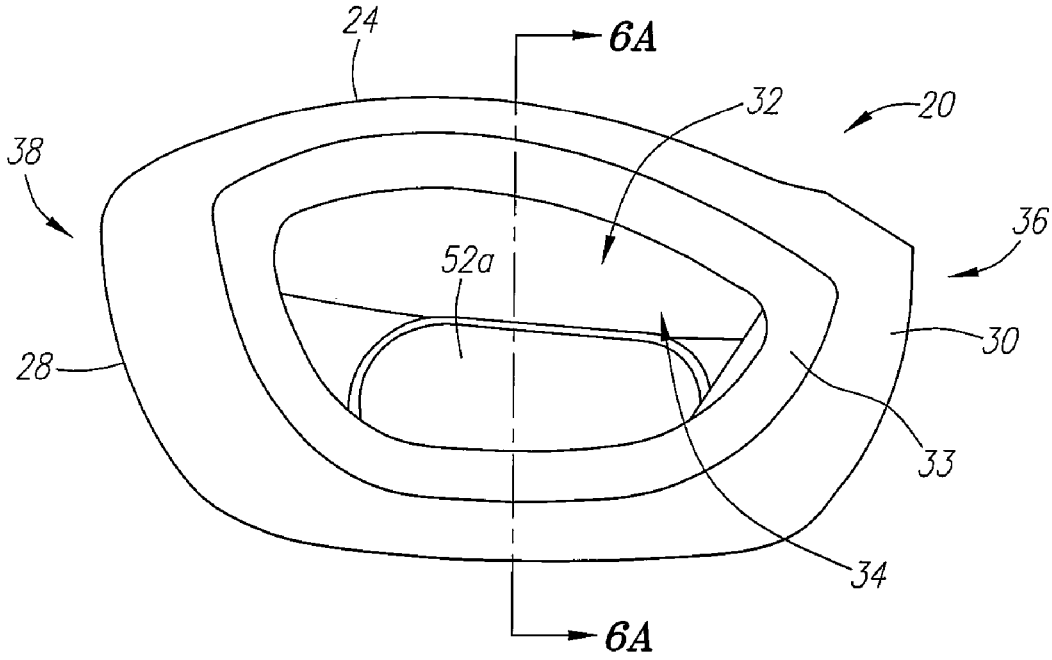
FIG. 6 is a front view of the body of a golf club head of FIG. 1.
Figure 6A:
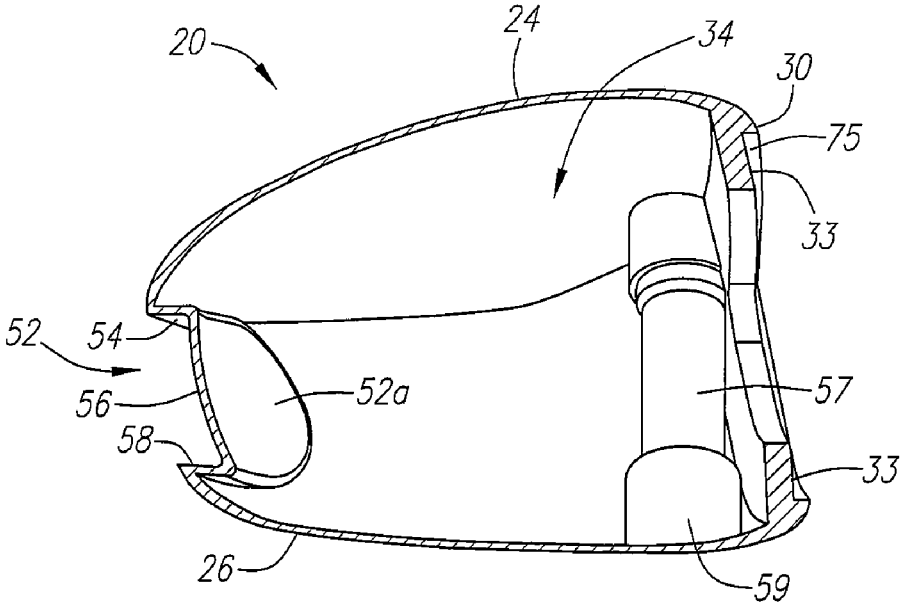
FIG. 6A is a cross-sectional view taken along the line 6A-6A of FIG. 6.

FIGS. 6 and 6A best illustrate the hollow interior 34 of the club head 20. As shown in FIGS. 6 and 6A, the recessed portion 33 of the front wall 30 encompasses the opening 32 forming a support for placement and attachment of the striking plate insert 40 thereon. The front wall 30 has a shoulder 75 that preferably engages a perimeter 77 of the striking plate insert 40. A portion of the interior surface of the striking plate insert 40 will engage the exterior surface of the recessed portion 33 of the front wall 30. The thickness of the recessed portion 33 of the front wall 30 is preferably thicker than the crown 24, the sole 26 or the ribbon 28.

Also shown in FIG. 6A is the hosel 57, which is disposed within the hollow interior 34, and is located near the heel end 36. The hosel 57 is preferably composed of an aluminum material, and preferably has a mass ranging from 3 to 10 grams, more preferably from 4 to 8 grams, and most preferably has a mass of 6 grams. Alternatively, the hosel 57 may be composed of a strong polymer material such as a urethane or ABS material. A shaft, not shown, is disposed within the hosel 57 through a bore 55 in the crown 24. A hosel insert, not shown, is preferably used to interface between the shaft and the hosel 57. Such a hosel insert is described in U.S. Pat. No. 6,352,482, entitled Golf Club With Hosel Liner, which pertinent parts are hereby incorporated by reference. The hosel 57 is preferably positioned in a hosel base 59 and extends from the sole 26 to the crown 24. However, those skilled within the pertinent art will recognize that the hosel need not extend all the way to the side 26 and may also extend outside of the body 22 without departing from the scope and spirit of the present invention.

Figure 3:
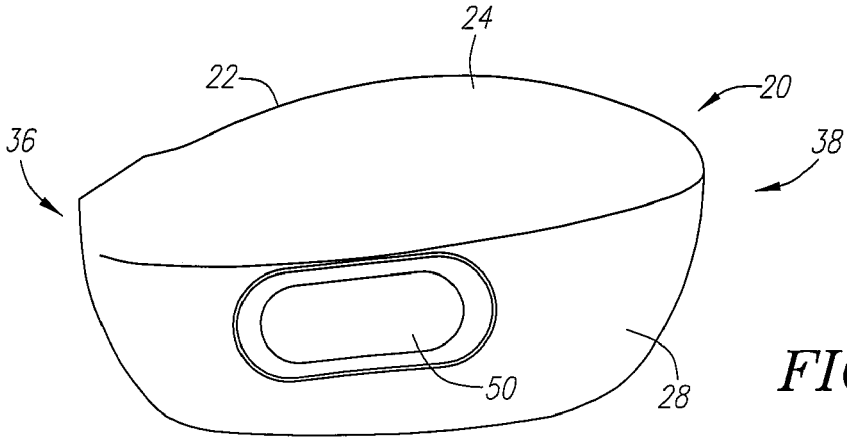
FIG. 3 is a rear view of a golf club head of FIG. 1.
Figure 4:
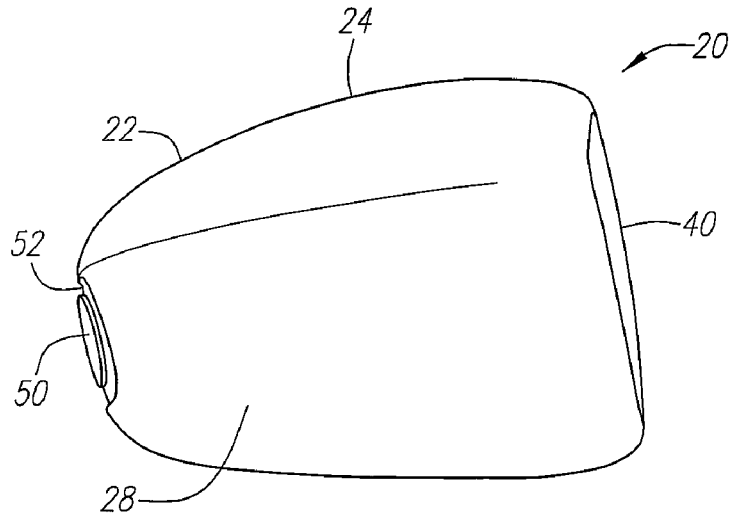
FIG. 4 is a toe side view of the golf club head of FIG. 1.
Figure 5:
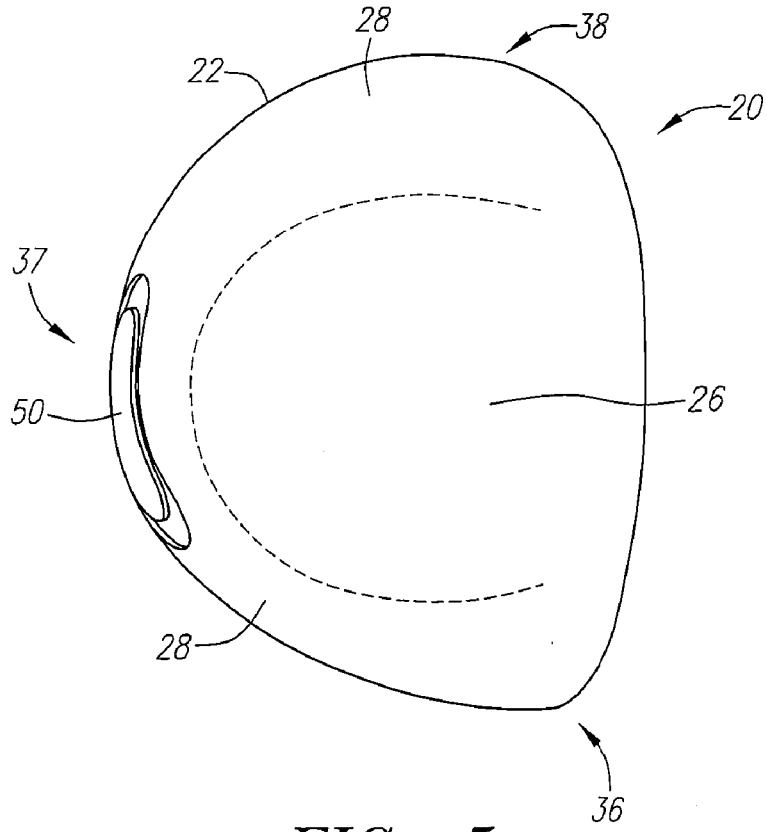
FIG. 5 is a bottom plan view of the golf club head of FIG. 1.

Also shown in FIGS. 6 and 6*a* are the walls of the aft recess 52. The aft recess 52 preferably extends into the hollow interior 34 forming an aft recess projection 52*a*. The aft recess 52 is preferably defined by upper recess wall 54, main recess wall 56 and lower recess wall 58. The rear weighting member 50 is positioned within the aft recess 52, as best shown in FIG. 3.

The rear weighting member 50 is preferably composed of a metal material such as steel, steel alloys, brass, tungsten, tungsten alloys, or other high density materials. The rear weighting member 50 is preferably co-molded with a body 22 or press-fitted within the aft recess 52 subsequent to fabrication of the body 22. In another attachment process, the body 22 is first bladder molded and then the rear weighting member 50 is bonded within the aft recess 52 using an adhesive. The adhesive is placed on the exterior surface of the walls 54, 56 and 58 that define the aft recess 52. In yet another attachment process, the body 22 is first bladder molded and then the rear weighting member 50 is mechanically secured within the aft recess 52. Those skilled in the pertinent art will recognize other methods for attachment of the rear weighting member 50 within the aft recess 52 without departing from the scope and spirit of the present invention.

Figure 11:
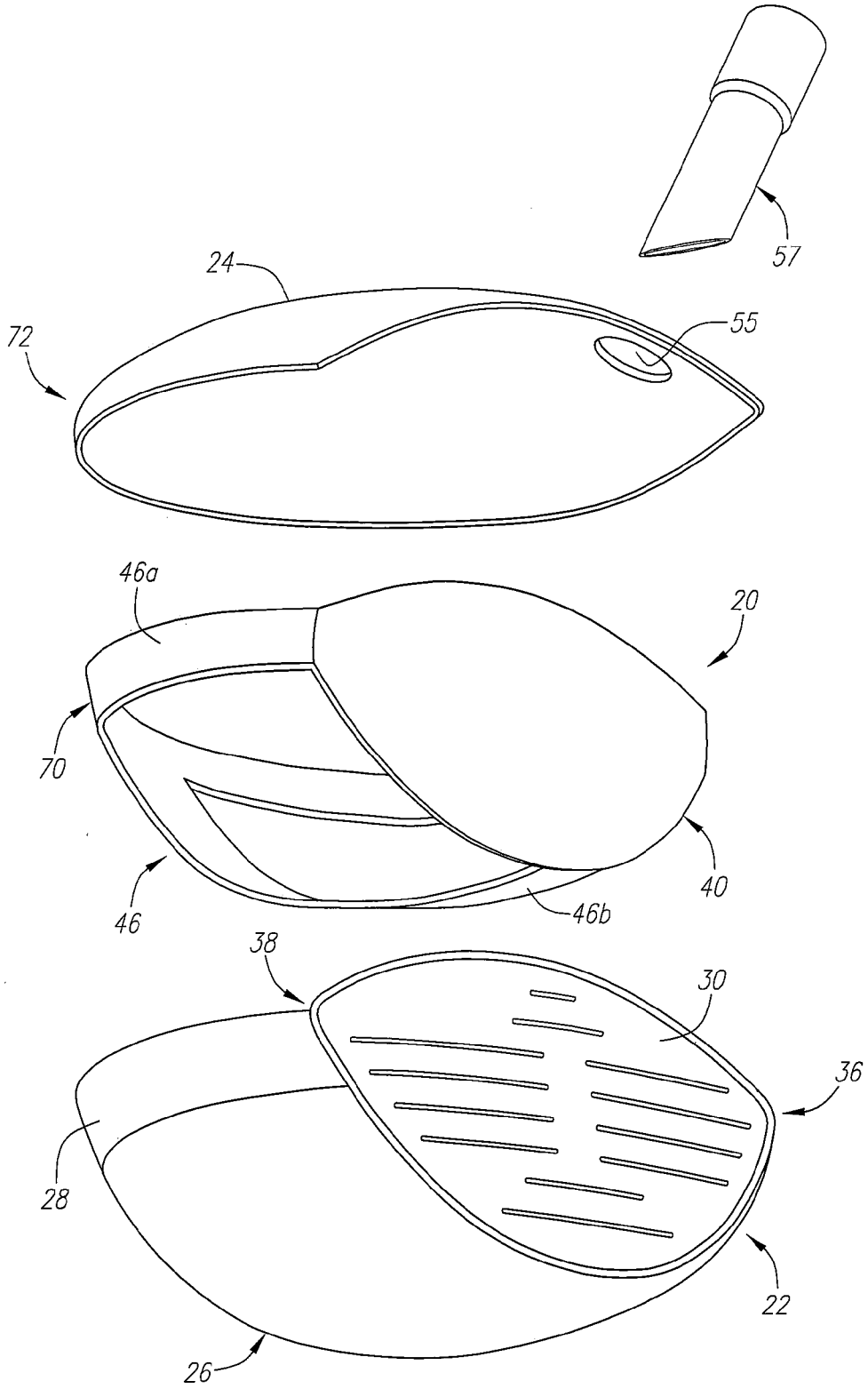
FIG. 11 is an exploded top perspective view of a golf club according to the second embodiment of the present invention.

A second embodiment of the golf club head 20 of the present invention is shown in FIG. 11. In this embodiment, the golf club head has a body 22 that is generally composed of a composite material such as continuous fiber pre-preg material (including thermosetting materials or thermoplastic material for the resin), other thermosetting materials such as thermosetting polyurethane, or other thermoplastic materials such as polyamides, polyimides, polycarbonates, PBT (polybutlene Terephthalate), blends of polycarbonate and the like. The body 22 is preferably manufactured through injection molding, bladder-molding, resin transfer molding, resin infusion, compression molding, or similar process.

The body 22 includes a front wall 30, a sole 26, and a ribbon 28 that generally extends from a toe end 38 to a heel end 36. The ribbon 28 generally begins at one end of the front wall 30 and ends at an opposite end of the front wall 30. A rear 70 of the body 22 is opposite the front wall 30 and is defined by portions of the ribbon 28, the sole 26, and a separate crown plate 72.

The club head 20 has a weight piece 46 disposed in the body 22. The weight piece 46 is preferably embedded within the composite material of the body 22. A separate crown plate 72 is attached to the ribbon 28 and front wall 30 of the body 22. A hosel 57 is positioned within the hollow interior 34 of the club head 20.

The weight piece 46 includes a striking plate insert 40 which supports the front wall 30. The weight piece 46 further includes a first strip 46*a* that extends from approximately the heel end 36 along the ribbon 28 through the rear 70 to the toe end 38, as well as a second strip 46*b* that extends from the bottom of the striking plate insert 40 along the sole 26 to the rear 70. However, the weight piece 46 may extend only along the sole 26 or along the rear 70 of the ribbon 28, the heel end 36 of the ribbon 28, and the toe end 38 of the ribbon 28, or any combination thereof. Preferably, the weight piece 46 occupies the majority of area of the ribbon 28, although the weight piece 46 may also occupy a small area of the ribbon 28.

The weight piece 46 is preferably composed of a high density material, such that the weight piece 46 has a density greater than that of the composite body 22. The weight piece 46 may be a single piece of metal, such as steel or titanium. Alternatively, the weight piece 46 may be composed of a film loaded with a high density metal (like tungsten), or a metal material, such as copper, tungsten, steel, aluminum, tin, silver, gold, platinum, or the like. The weight piece 46 may also be a thermoplastic material filled with metal to an appropriate density. The metal filler may be tungsten, brass, copper, steel, tin, or the like.

The crown plate 72 is preferably composed of a metal such as aluminum, titanium, or stainless steel, and is attached through the use of an adhesive, bound during processing, or fixed in some other conventional manner.

Also shown in FIG. 11, is the hosel 57, which is disposed within the hollow interior 34, and is located near the heel end 36. Alternatively, the hosel 57 may be formed in a portion of the crown plate 72. The hosel 57 is preferably composed of an aluminum material, and preferably has a mass ranging from 3 to 10 grams, more preferably from 4 to 8 grams, and most preferably has a mass of 6 grams. Alternatively, the hosel 57 is composed of a strong polymer material such as a urethane or ABS material. A shaft, not shown, is disposed within the hosel 57 using a hosel insert, not shown.

Figure 12:
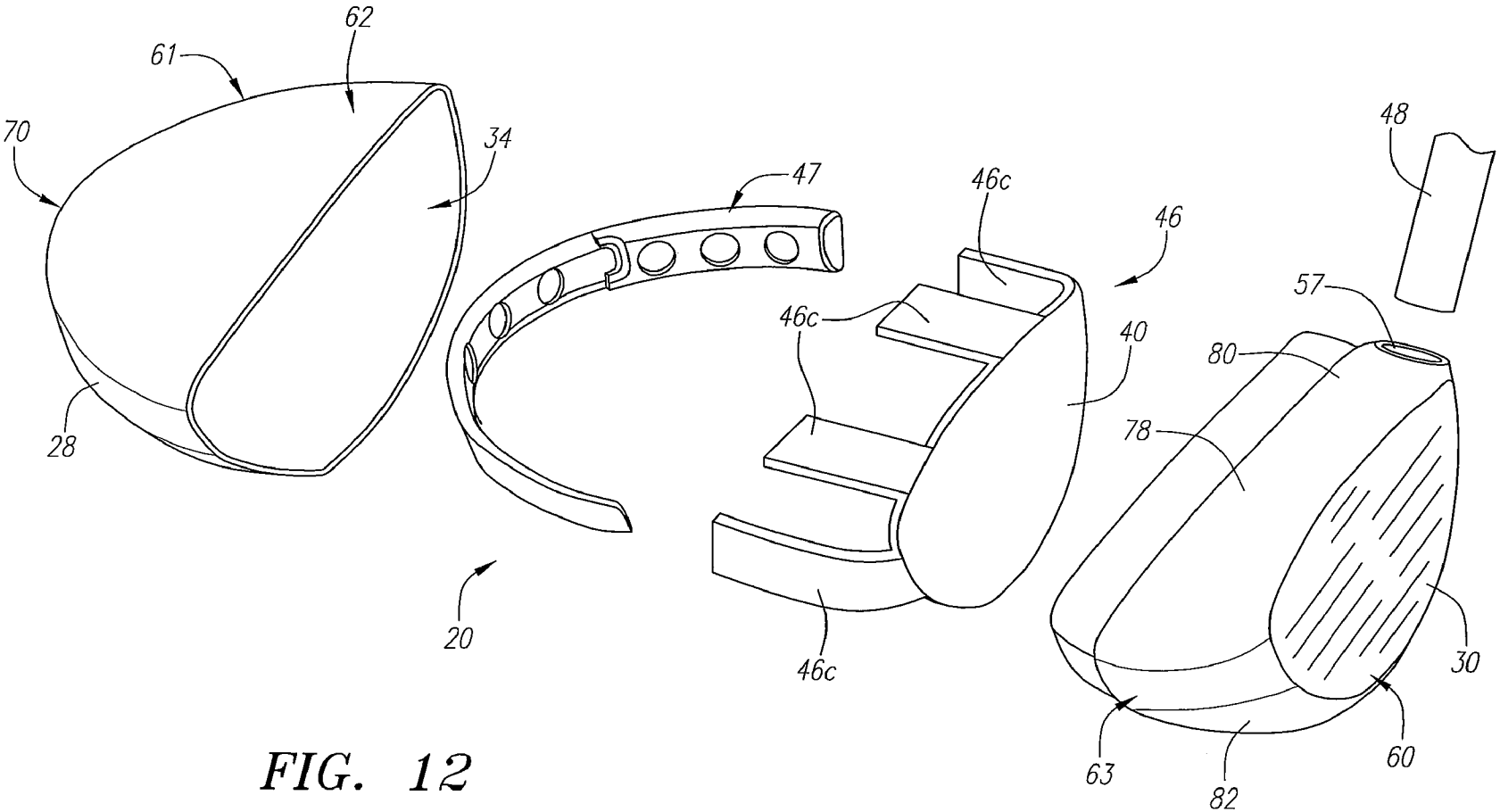
FIG. 12 is an exploded top perspective view of a golf club according to the third embodiment of the present invention.

A third embodiment of the golf club head 20 of the present invention is shown in FIG. 12. In this embodiment, the golf club head 20 has a face component 60 and an aft-body 61. The aft-body 61 has a crown portion 62 and a sole portion 64. The club head 20 has a heel section 66 proximate the shaft 48, a toe section 68 opposite the heel section 66, and a rear section 70 opposite the face component 60. A hosel 57, not shown, is positioned within the hollow interior 34 of the club head 20 in the face component 60.

The face component 60 is generally composed of a composite material, such as a continuous fiber pre-preg material or other thermosetting or thermoplastic material. The face component 60 includes a front wall 30 and return portion 63. Like the body 22 in the second embodiment of the golf club head 20, shown in FIG. 11, the face component 60 includes a weight piece 46 preferably embedded therein, the weight piece 46 includes a striking plate insert 40 and return portion tabs 46*c*. The weight piece 46 is preferably composed of a titanium or stainless steel material. Such titanium materials include pure titanium and titanium alloys. Other metals for the weight piece 46 include other high strength steel alloy metals and amorphous metals. Alternatively, the weight piece 46 may be composed of a film or thermoplastic material filled with a metal to achieve the desired density for the weighted piece.

The aft-body 61 is composed of a composite material such as a plurality of plies of pre-preg, typically six or seven plies (preferably ranging from three plies to twenty plies) such as disclosed in U.S. Pat. No. 6,248,025, entitled Composite Golf Head And Method Of Manufacturing, which is hereby incorporated by reference in its entirety. The aft-body 61 has a weight strip 47 disposed in the ribbon 28 of the club head 20. The weight strip 46 is preferably embedded within the layers of the plies of pre-peg or the aft-body 61.

The weight strip 47 is are preferably composed of a film located with a high density metal (like tungsten), or a metal material such as copper, tungsten, steel, aluminum, tin, silver, gold, platinum, or the like. The weight strip 47 may be a thermoplastic material filled with metal to an appropriate density, and the metal filler may be tungsten, brass, copper, steel, tin, or the like. Further, the weight strip 47 may be a single piece of metal such as tungsten, brass, copper, steel, tin, or the like. The weight strip 47 has a density greater than the composite material of the aft-body 61.

The weight strip 47 preferably extends along the entire ribbon 28 of the aft-body 61, from the heel end 36 to the toe end. However, the weight strip 47 may only extend along only a portion of the ribbon 28, such as the rear 70, the heel end 34, the toe end 38, or any combination thereof.

Figure 13:
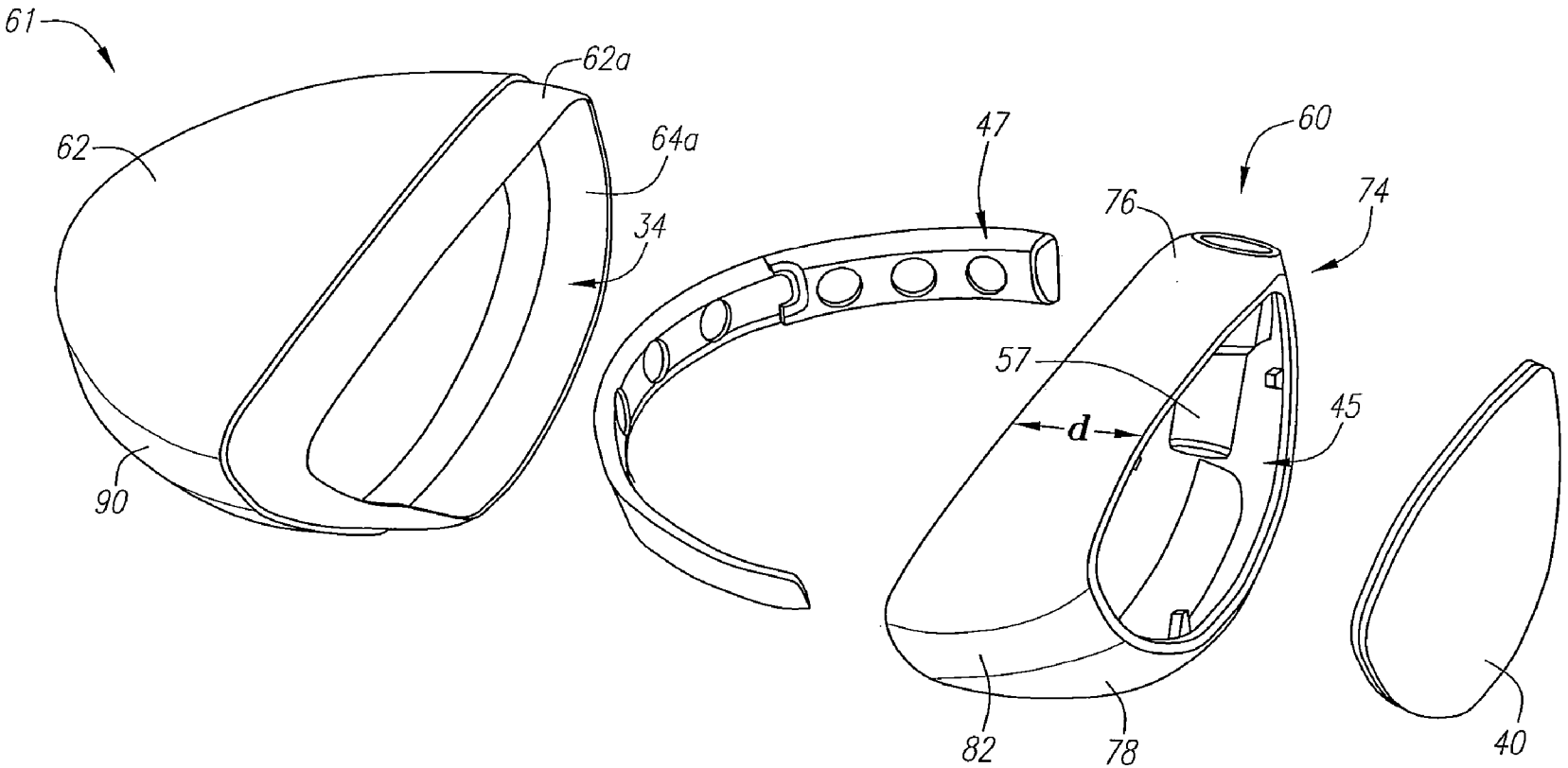
FIG. 13 is an exploded top perspective of a golf club head of according to the fourth embodiment of the present invention.
Figure 14:
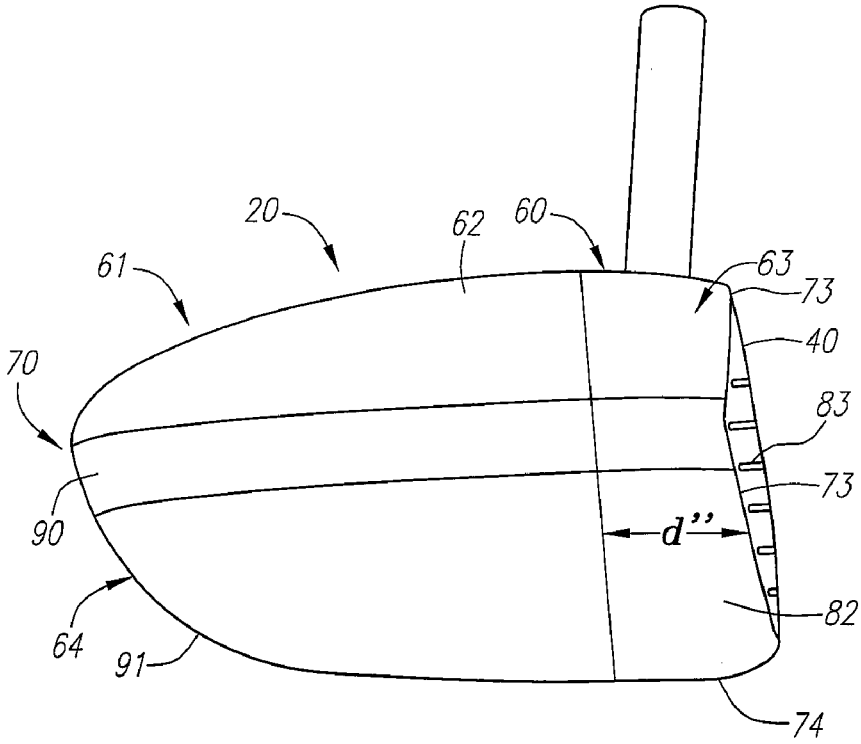
FIG. 14 is a toe side view of the golf club head of FIG. 13.
Figure 15:
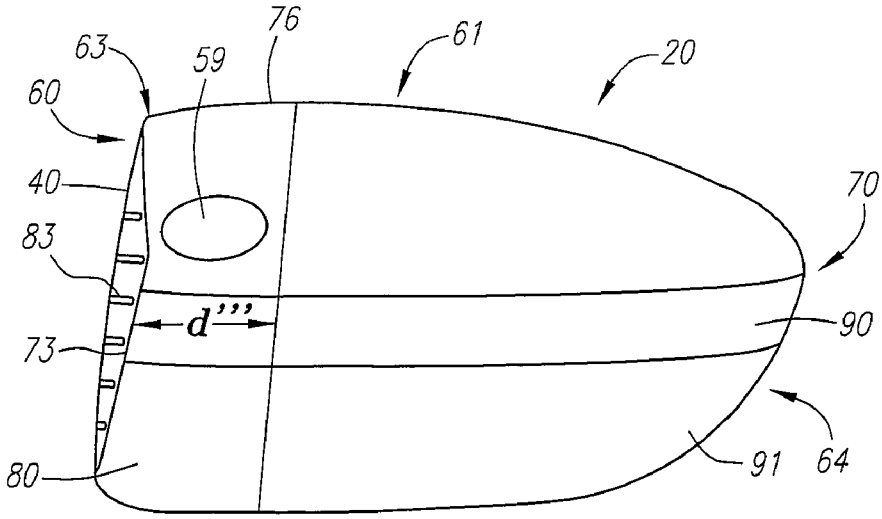
FIG. 15 is a heel side view of the golf club head of FIG. 13.

A fourth embodiment of the golf club head 20 of the present invention is shown in FIGS. 13-15, such as disclosed in U.S. Pat. No. 6,565,452, for a Multiple Material Golf Club Head with Face Insert, filed on Feb. 28, 2002, and is hereby incorporated by reference in its entirety. In this embodiment, the golf club head 20, a face component 60 and an aft-body 61. The face component 60 has a face cup and has a separate striking plate insert 40, which is placed within an opening 45 of a face cup 74. The aft-body 61 has a crown portion 62 and a sole portion 64.

The face cup 74 has a return portion 63 that extends laterally rearward from the perimeter 73 of the front wall. The striking plate insert 40 is joined to the face cup 74 of the face component 60 in a manufacturing process discussed in co-pending U.S. application Ser. No. 10/710,143, entitled Method for Processing a Golf Club Head with Cup Shaped Face Component, filed on Jun. 22, 2004, and hereby incorporated by reference in its entirety.

The return portion 63 of the face cup preferably includes an upper lateral section 76, a lower lateral section 78, a heel lateral section 80 and a toe lateral section 82. Thus, the return portion 63 preferably encircles the striking plate insert 40 a full 360 degrees. However, those skilled in the pertinent art will recognize that the return portion 63 may only encompass a partial section of the striking plate insert 40, such as 270 degrees or 180 degrees, and may also be discontinuous.

The upper lateral section 76 extends rearward, towards the aft-body 61, a predetermined distance, d, to engage the crown 62. In a preferred embodiment, the predetermined distance ranges from 0.2 inch to 1.0 inch, more preferably 0.40 inch to 0.75 inch, and most preferably 0.68 inch, as measured from the perimeter 73 of the striking plate insert 40 to the rearward edge of the upper lateral section 76. In a preferred embodiment, the upper lateral section 76 has a general curvature from the heel end 36 to the toe end 38. The upper lateral section 76 has a length from the perimeter 73 of the striking plate insert 40 that is preferably a minimal length near the center of the striking plate insert 40, and increases toward the toe end 38 and the heel end 36. However, those skilled in the relevant art will recognize that the minimal length may be at the heel end 36 or the toe end 38.

The face component 60 engages the crown portion 62 of the aft-body 61 along a substantially horizontal plane. The crown portion 62 has a crown undercut portion 62*a*, which is placed under the return portion 63. Such an engagement enhances the flexibility of the striking plate insert 40 allowing for a greater coefficient of restitution. The crown portion 62 of the aft-body 61 and the upper lateral section 76 of the face component 60 are attached to each other as further explained below.

The heel lateral section 80 is substantially perpendicular to the striking plate insert 40, and the heel lateral section 80 covers the hosel 57 before engaging an optional ribbon section 90 and a bottom section 91 of the sole portion 64 of the aft-body 61. The heel lateral section 80 is attached to the sole portion 64, both the ribbon 28 and the bottom section 91, as explained in greater detail below. The heel lateral section 80 extends inward a distance, d''', from the perimeter 73 a distance of 0.250 inch to 1.50 inches, more preferably 0.50 inch to 1.0 inch, and most preferably 0.950 inch. The heel lateral section 80 preferably has a general curvature at its edge.

At the other end of the face component 60 is the toe lateral section 82. The toe lateral section 82 is attached to the sole portion 64, both the ribbon 28 and the bottom section 91, as explained in greater detail below. The toe lateral section 82 extends inward a distance, d', from the perimeter 73 a distance of 0.250 inch to 1.50 inches, more preferably 0.75 inch to 1.30 inch, and most preferably 1.20 inch. The toe lateral section 82 preferably has a general curvature at its edge.

The lower lateral section 78 of the face component 60 extends inward, toward the aft-body 61, a predetermined distance to engage the sole portion 64. In a preferred embodiment, the predetermined distance ranges from 0.2 inch to 1.25 inches, more preferably 0.50 inch to 1.10 inch, and most preferably 0.9 inch, as measured from the perimeter 73 of the striking plate insert 40 to the edge of the lower lateral section 78. In a preferred embodiment, the lower lateral section 78 has a general curvature from the heel end 36 to the toe end 38. The lower lateral section 78 has a length from the perimeter 73 of the striking plate section 72 that is preferably a minimal length near the center of the striking plate section 40, and increases toward the toe end 38 and the heel end 36.

The sole portion 64 has a sole undercut 64*a* for placement under the return portion 63. The sole 64 and the lower lateral section 78, the heel lateral section 80 and the toe lateral section 82 are attached to each other as explained in greater detail below.

The aft-body 61 is preferably composed of a non-metal material, preferably a composite material such as continuous fiber pre-preg material (including thermosetting materials or a thermoplastic materials for the resin). Other materials for the aft-body 61 include other thermosetting materials or other thermoplastic materials such as injectable plastics. The aft-body 61 is preferably manufactured through bladder-molding, resin transfer molding, resin infusion, injection molding, compression molding, or a similar process. Alternatively, the aft-body may be composed of a metallic material such as magnesium, titanium, stainless steel, or any other steel or titanium alloy.

The crown portion 62 of the aft-body 61 is generally convex toward the sole portion 64, and engages the ribbon section 90 of sole portion 64 outside of the engagement with the face member 60. Those skilled in the pertinent art will recognize that the sole portion 64 may not have a ribbon section 90. The crown portion 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The sole portion 64, including the bottom section 91 and the optional ribbon section 90 which is substantially perpendicular to the bottom section 91, preferably has a thickness in the range of preferably in the range of 0.028 inch to 0.040 inch, and most preferably has a thickness of 0.033 inch.

The assembled face component 60 may then be attached to the aft body 61. The face component 60, with an adhesive on the interior surface of the return portion 63, is placed within a mold with a preform of the aft-body 61 for bladder molding. The return portion 63 is placed and fitted into the undercut portions 62*a* and 64*a*. Also, the adhesive may be placed on the undercut portions 62*a* and 64*a*. Such adhesives include thermosetting adhesives in a liquid or a film medium. During this attachment process, a bladder is placed within the hollow interior of the preform and face component 60, and is pressurized within the mold, which is also subject to heating. The co-molding process secures the aft-body 61 to the face component 60. In another attachment process, the aft-body 61 is first bladder molded and then is bonded to the face component 60 using an adhesive, or mechanically secured to the return portion 63.

Figure 16:
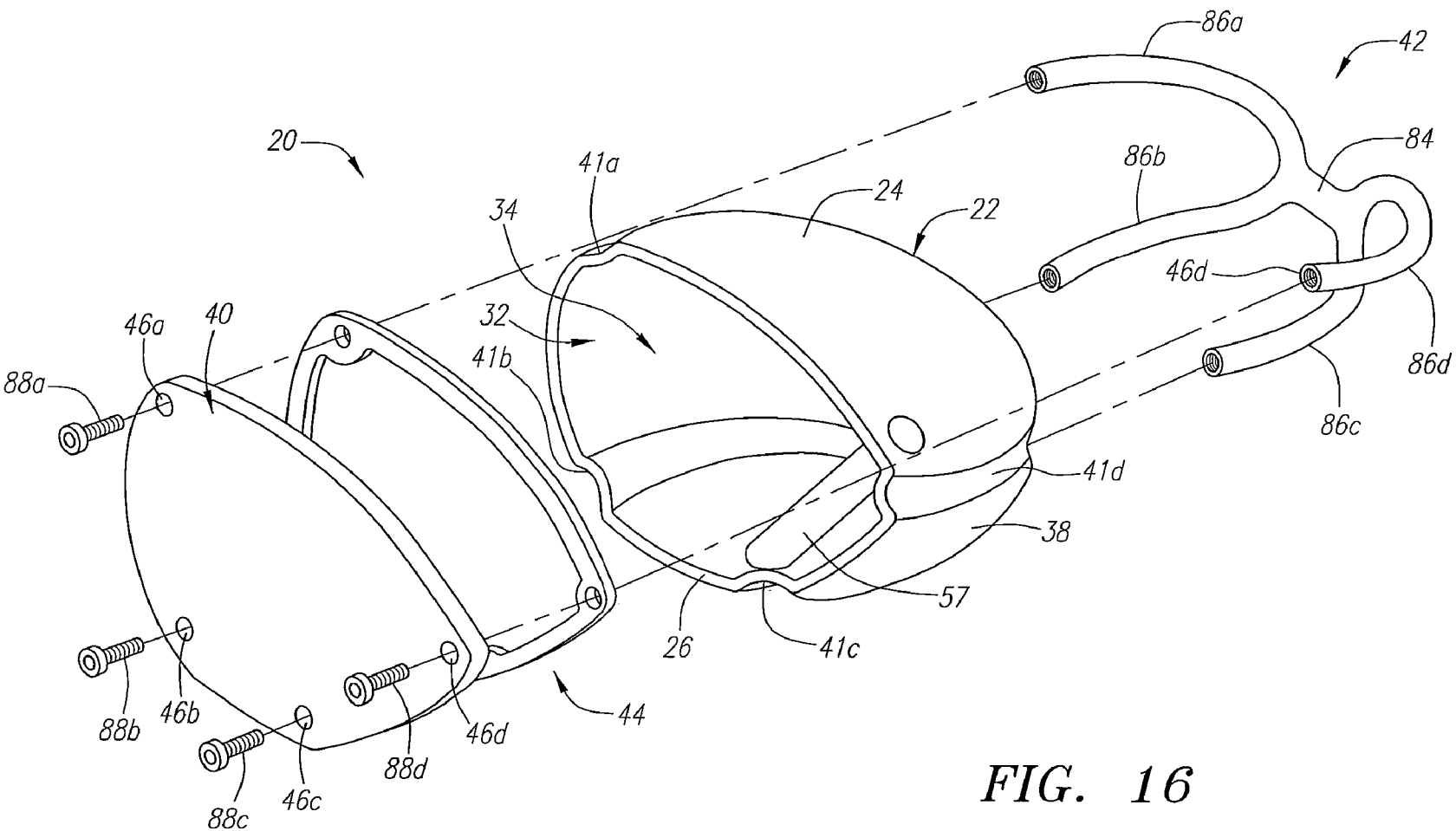
FIG. 16 is an exploded top perspective of the golf club head according to the fifth embodiment of the present invention.
Figure 17:
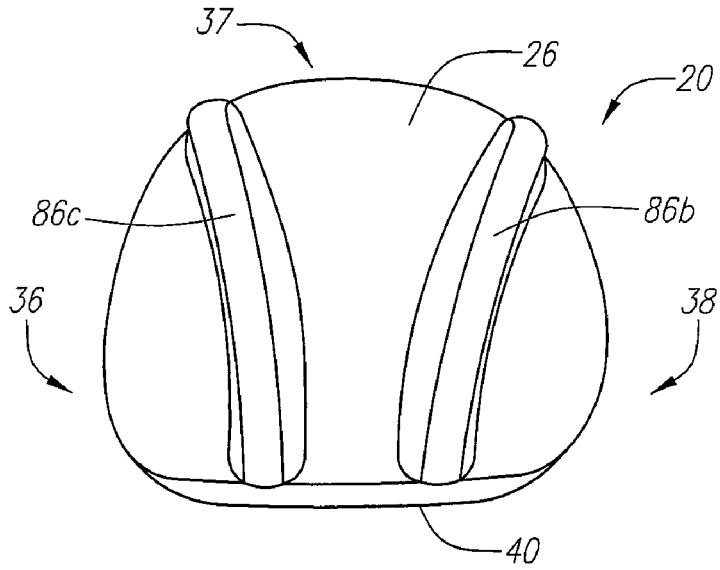
FIG. 17 is a bottom plan view of the golf club head of FIG. 16.
Figure 18:
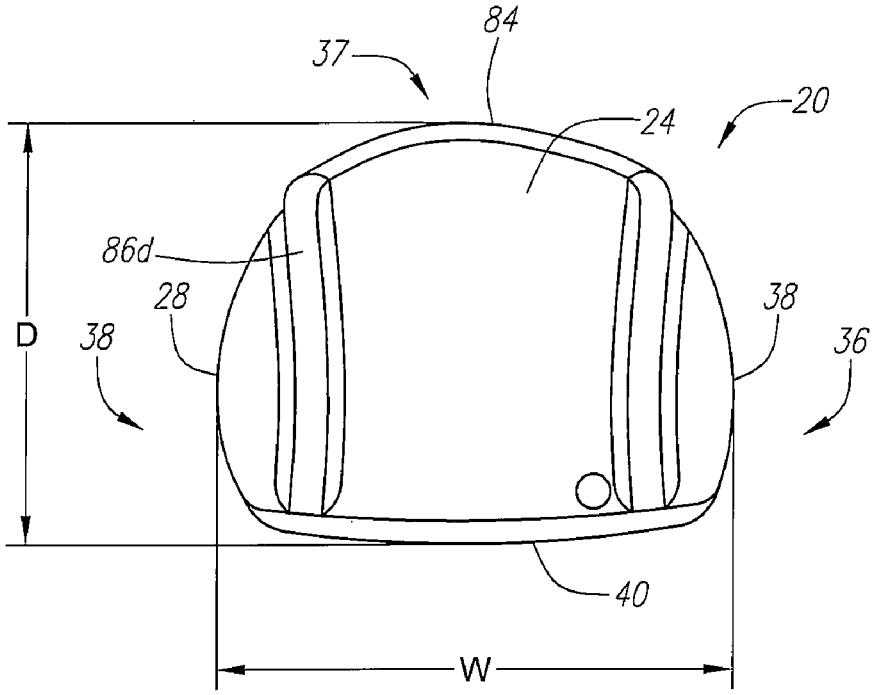
FIG. 18 is a top plan view of the golf club head of FIG. 16.

A fifth embodiment of the golf club head 20 of the present invention is shown in FIGS. 16-18. In this embodiment, the golf club head 20 includes a body 22, a striking plate 40 a weighting frame 42, and an optional support gasket 44. A more thorough description of such a golf club head 20 is set forth in U.S. Pat. No. 6,672,975, for a Golf Club Head, and assigned to the assignee of the present application, and which is hereby incorporated by reference in its entirety.

The body 22 is preferably composed of a light weight or low-density material, preferably a non-metal material or a low-density (less than 4.5 grams per cubic centimeter) metal material, such as a polycarbonate material. Other materials for the body 22 include a composite material such as a continuous fiber pre-preg material (including thermosetting materials or a thermoplastic material for the resin), other thermosetting materials such as thermosetting polyurethane, or other thermoplastic materials such as polyamides, polyimides, polycarbonates, PBT (Polybutlene Terephthalate), blends of polycarbonate and polyurethane, and the like. The body 22 is preferably manufactured through injection molding, bladder-molding, resin transfer molding, resin infusion, compression molding, or a similar process. A preferred metal material for the body 22 is aluminum, tin or magnesium. The striking plate 40 is attached to the frame 42 and over the opening 32. Preferably the striking plate 40 is positioned over and attached to the support gasket 44.

The striking plate 40 is preferably composed of a formed metal material, however, the striking plate 40 may also be composed of a machined metal material, a forged metal material, a cast metal material or the like. The striking plate 40 preferably is composed of a formed titanium or steel material. Titanium materials useful for the striking plate 40 include pure titanium and titanium alloys. Other metals for the striking plate 40 include other high strength steel alloy metals and amorphous metals. The exterior surface of the striking plate 40 typically has a plurality of scorelines thereon, not shown.

The striking plate 40 preferably has an elliptical shape or a trapezoidal shape. The striking plate 40 preferably has a-plurality of holes 46*a-d* for insertion of the bolts 88*a-d* there through.

Preferably, the striking plate 40 has uniform thickness that ranges from 0.040 inch to 0.250 inch, more preferably a thickness of 0.080 inch to 0.120 inch, and is most preferably 0.108 inch for a titanium alloy striking plate 24 and 0.090 inch for a stainless steel striking plate 40.

The weighting frame 42 is preferably composed of a metal material such as stainless steel, titanium alloy, aluminum, magnesium and other like metal materials. In an alternative embodiment, the weighting frame 42 is composed of a thermoplastic material. The frame 42 is preferably composed of four arms 86*a-d* and a central body 84. In the preferred embodiment, each of the arms 86*a-d* are positioned within a corresponding groove 40*a-d* of the body 22. Each of the grooves 40*a-d* are generally shaped to receive an arm 86*a-d*. Each arm 86*a-d* has a length sufficient to extend from the aft end 37 of the body 22 to the opening 32. In a preferred embodiment, each arm 86*a-d* is tubular with a threaded aperture at the forward end (opposite the central body 84) to receive a bolt for attachment of the striking plate 40 thereto. The frame 42 preferably engages the striking plate 40 at each of the corners (upper heel, lower heel, upper toe and lower toe) of the striking plate 40. The frame 42 also increases the moment of inertia of the golf club head 20 since mass is positioned at the outer extremes of the golf club head 20.

Further, the attachment of the striking plate 40 to the frame 42 provides the ability to use an amorphous metal for the striking plate 40 and a different material for the frame 42 and the body 22 thereby eliminating problems associated with bonding amorphous metals to other metals. Although attachment through the use of bolts is preferred, other joining means may be utilized such as riveting, self taping screws, localized friction or welding, spot welding, local bonding, melt or solvent bonding, and the like.

Preferably, the frame 42 has a mass ranging from 30 grams to 90 grams, more preferably from 40 grams to 70 grams. The hosel 57 preferably has a mass ranging from 3 to 10 grams, more preferably from 4 to 8 grams, and most preferably has a mass of 6 grams. Additionally, epoxy, or other like flowable materials, in an amount ranging from 0.5 grams to 5 grams, may be injected into the hollow interior 50 of the golf club head 20 for selective weighting thereof.

As shown in FIGS. 17 and 18, the depth, D, of the club head 20 from the striking plate 40 to the after end 37 of the crown 24 preferably-ranges from 3.0 inches to 4.5 inches, and is most preferably 3.74 inches. The height of the club head 20, as measured while in address position from the sole 26 to the crown 24, preferably ranges from 2.0 inches to 3.5 inches, and is most preferably 2.62 inches. The width, W, of the club head 20 from the toe end 38 to the heel end 36 preferably ranges from 4.0 inches to 5.5 inches, and more preferably 4.57 inches. The height of the striking plate 40, preferably ranges from 1.8 inches to 2.5 inches, and is most preferably 2.08 inches. The width, w, of the striking plate insert from the toe end to the heel end preferably ranges from 3.0 inches to 5.0 inches, and more preferably 3.52 inches.

Another aspect of the golf club head 20 of the present invention is directed a golf club head 20 that has a high coefficient of restitution for greater distance of a golf ball hit with the golf club head of the present invention. The coefficient of restitution (also referred to herein as "COR") is determined by the following equation:

$$e = \frac{y_2 - y_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The golf club head 20 preferably has a coefficient of restitution ranging from 0.80 to 0.94, as measured under conventional test conditions.

The coefficient of restitution of the club head 20 of the present invention under standard USGA test conditions with a given ball preferably ranges from approximately 0.80 to 0.94, more preferably ranges from 0.82 to 0.89 and is most preferably 0.86.

Figure 7:
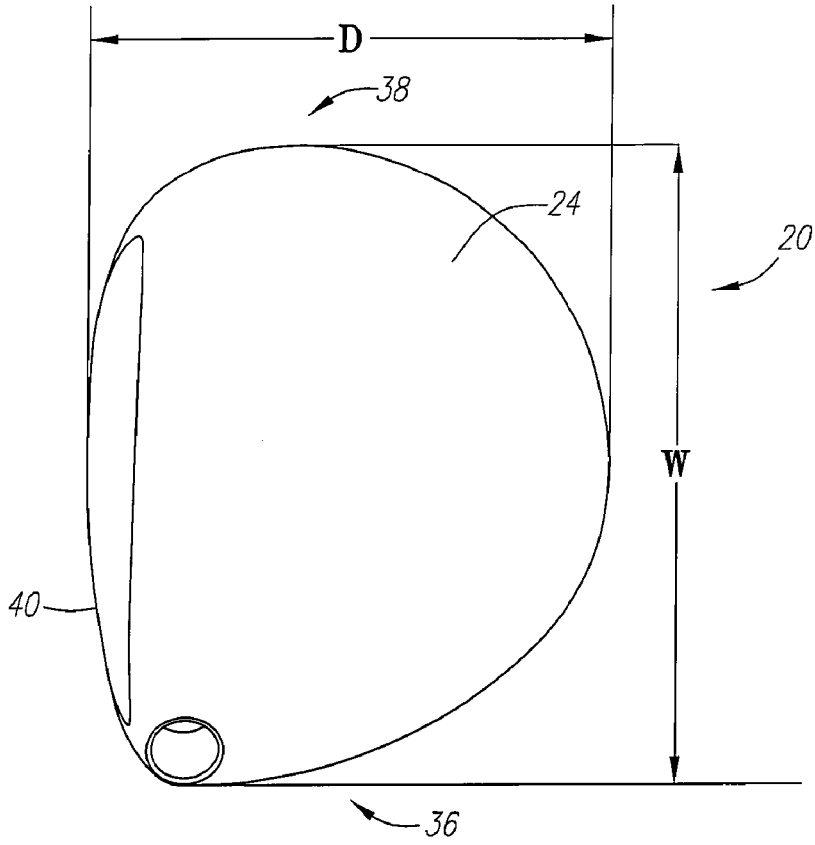
FIG. 7 is a top plan view of a golf club head of the present invention illustrating the Y axis and X axis.
Figure 8:
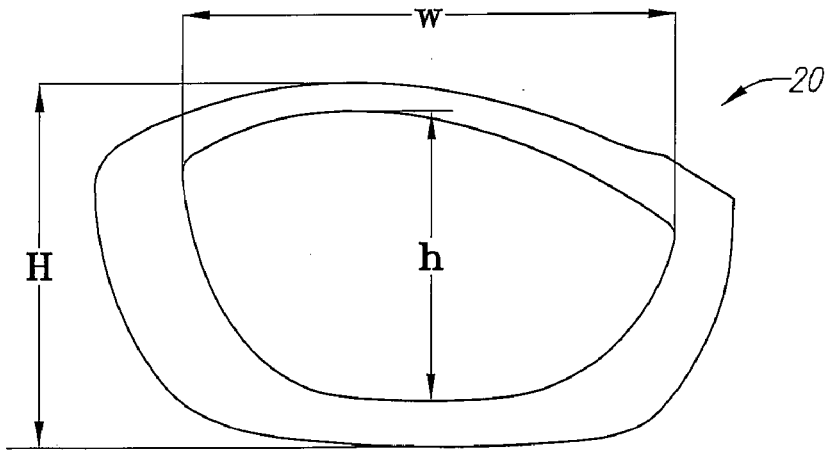
FIG. 8 is a front view of a golf club head of the present invention.
Figure 9:
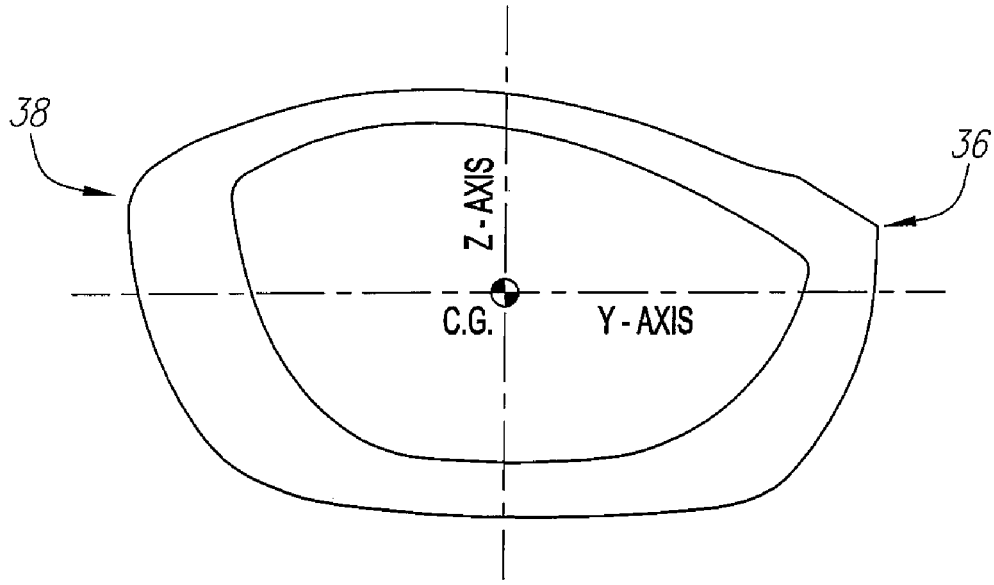
FIG. 9 is a front plan view of a golf club head of the present invention illustrating the Z axis and Y axis.
Figure 10:
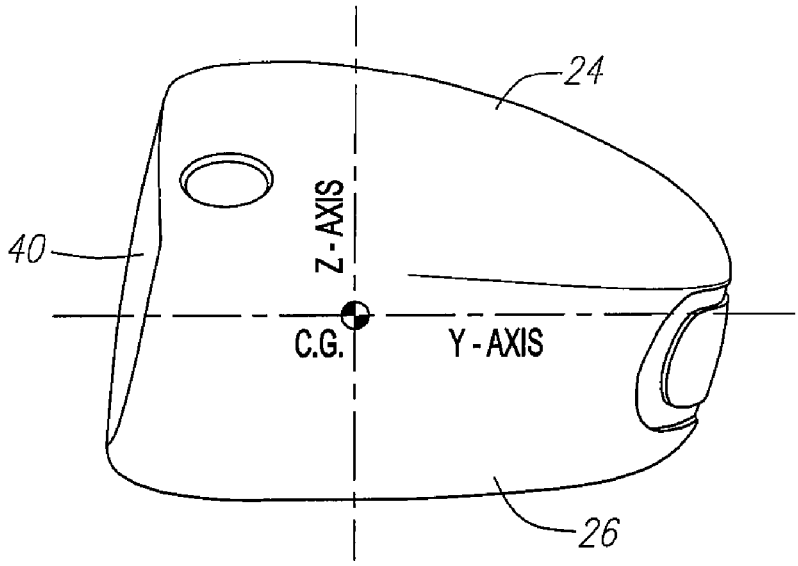
FIG. 10 is a heel side plan view of a golf club of the present invention illustrating the Z axis and X axis.

FIGS. 7, 9, and 10 illustrate the axes of inertia through the center of gravity of the golf club head. The axes of inertia are designated X, Y and Z. The X axis extends from the striking plate insert 40 through the center of gravity, CG, and to the rear of the golf club head 20. The Y axis extends from the toe end 38 of the golf club head 20 through the center of gravity, CG, and to the heel end 36 of the golf club head 20. The Z axis extends from the crown 24 through the center of gravity, CG, and to the sole 26.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 20 of the present invention is preferably greater than 3000 g-cm$^2$, and more preferably greater than 3500 g-cm$^2$. The moment of inertia, Iyy, about the Y axis for the golf club head 20 of the present invention is preferably in the range from 2000 g-cm$^2$ to 4000 g-cm$^2$, more preferably from 2300 g-cm$^2$ to 3800 g-cm$^2$. The moment of inertia, Ixx, about the X axis for the golf club head 20 of the present invention is preferably in the range from 1500 g-cm$^2$ to 3800 g-cm$^2$, more preferably from 1600 g-cm$^2$ to 3100 g-cm$^2$.

The golf club head 20 of the present invention has moments of inertia Ixx, Iyy and Izz and a center of gravity location that are optimized to improve the performance of the club head. An improved robustness efficiency parameter, also referred to herein as "REP," for greater inertial properties for both back spin and side spin optimization for impact variation on the club face is captured by the following equation:

$$REP = \left[\frac{I_{xx}}{(I_{yy} + 1.7(I_{zz}))}\right] * \frac{Dcg}{Rball}$$

wherein Dcg is the distance from the face impact to the club head center of gravity. For convenience, the distance Dcg is taken as the distance from the center of the striking face to the center of mass of the club head. Rball is simply the radius of the golf ball, which is set by the rules of golf. Ixx is the inertia about a fore/aft axis through the center of gravity. Izz is the club head inertia about a vertical axis through the center of gravity. Iyy is the club head inertia about an axis in the heel to toe direction through the center of gravity. In the parameterized relationship, the Izz inertia term is weighted by a factor of 1.7. This factor exists because the hit distribution variation is greater in the near horizontal direction than in the vertical direction. The REP equation optimizes the moments of inertia Izz and Iyy and the center of gravity relative to the moment of inertia Ixx.

TABLE ONE

| Example | Ixx (gcm$^2$) | Iyy (gcm$^2$) | Izz (gcm$^2$) | Volume (cc) | CG Depth (in.) | REP |
|---|---|---|---|---|---|---|
| 1 | 1568 | 3748 | 4271 | 442 | 1.59 | 0.270 |
| 2 | 1652 | 3006 | 3631 | 420 | 1.414 | 0.303 |
| 3 | 2277 | 2335 | 3406 | 420 | 1 | 0.334 |
| 4 | 2190 | 2301 | 3518 | 300 | 1.099 | 0.346 |
| 5 | 1800 | 2500 | 3550 | 330 | 1.4 | 0.351 |
| 6 | 2191 | 2327 | 3514 | 460 | 1.2 | 0.377 |
| 7 | 3096 | 3175 | 5001 | 460 | 1.22 | 0.385 |

Table One discloses measurements for several golf cub heads of the present invention, which are illustrated in FIGS. 1-18. All of the golf club heads of the present invention have a REP less than 0.420 and a Dcg of less than 1.70 inches, which provides the golf club heads of the present invention with minimized backspin and side spin variation for hit distributions across the club face. This improved spin robustness results in more consistent ball trajectories.

Example 1 is a golf club head according to the first embodiment of the current invention, with a body composed of a plies of pre-preg material and a striking plate insert composed of steel, and having a volume of 442 cubic centimeters.

Example 2 is a golf club head according to the first embodiment of the current invention, with a body composed of a plies of pre-preg material and a striking plate insert composed of steel, and having a volume of 420 cubic centimeters.

Example 3 is a golf club head according to the first embodiment of the current invention, with a body composed a magnesium material and a striking plate insert composed of steel, and having a volume of 420 cubic centimeters.

Example 4 is a golf club head according to the second embodiment of the current invention, with a body composed of a thermoplastic urethane material molded over a steel striking face and weighting members and a crown composed of aluminum, and having a volume of 300 cubic centimeters.

Example 5 is a golf club head according to the third embodiment of the current invention, with a face insert composed of a thermoplastic urethane material molded over a steel striking face and weighting members and a body composed of plies of pre-preg material, and having a volume of 330 cubic centimeters.

Example 6 is a golf club head according to the fourth embodiment of the current invention, with a body composed of plies of pre-preg material, weighting members, a face cup composed of magnesium, and a striking face composed of steel, and having a volume of 460 cubic centimeters.

Example 7 is a golf club head according to the fifth embodiment of the current invention, with a body composed of a plies of pre-preg material, with a stainless steel external frame, and a striking face composed of titanium, and having a volume of 460 cubic centimeters.

TABLE TWO

| | Club | Ixx (gcm$^2$) | Iyy (gcm$^2$) | Izz (gcm$^2$) | CG Depth (in.) | REP |
|---|---|---|---|---|---|---|
| 100 | 9 deg King Cobra ss427 | 2932 | 2429 | 4000 | 1.1 | 0.412 |
| 101 | Nike 350 11 deg | 2751 | 2066 | 3645 | 1.1 | 0.445 |
| 102 | King Cobra SS350 10 deg | 2588 | 2338 | 3526 | 1.2 | 0.453 |
| 103 | 8.5 Merit Ti Driver | 3185 | 1794 | 3896 | 1.0 | 0.461 |
| 104 | Titleist 983K | 3154 | 2358 | 4042 | 1.2 | 0.484 |
| 105 | 9.5 deg TaylorMade R510 | 2494 | 2083 | 3235 | 1.3 | 0.517 |
| 106 | 9.5 deg TaylorMade R580 | 2716 | 2421 | 3964 | 1.5 | 0.519 |
| 107 | 9.5deg Cleaveland Launcher | 3015 | 2358 | 3613 | 1.3 | 0.531 |
| 108 | 9.5 TaylorMadeR 540 | 2516 | 2108 | 3277 | 1.5 | 0.569 |

Table Two discloses the mass, center of gravity location, and moments of inertia Ixx, Iyy, and Izz about the center of gravity for some comparative golf club heads, all of which have a REP of 0.453 or greater. Because these conventional golf club heads have a larger REP value, they have increased ball side spin and back spin, therefore less ball flight robustness for variation of impact location on the club face.

Figure 19:
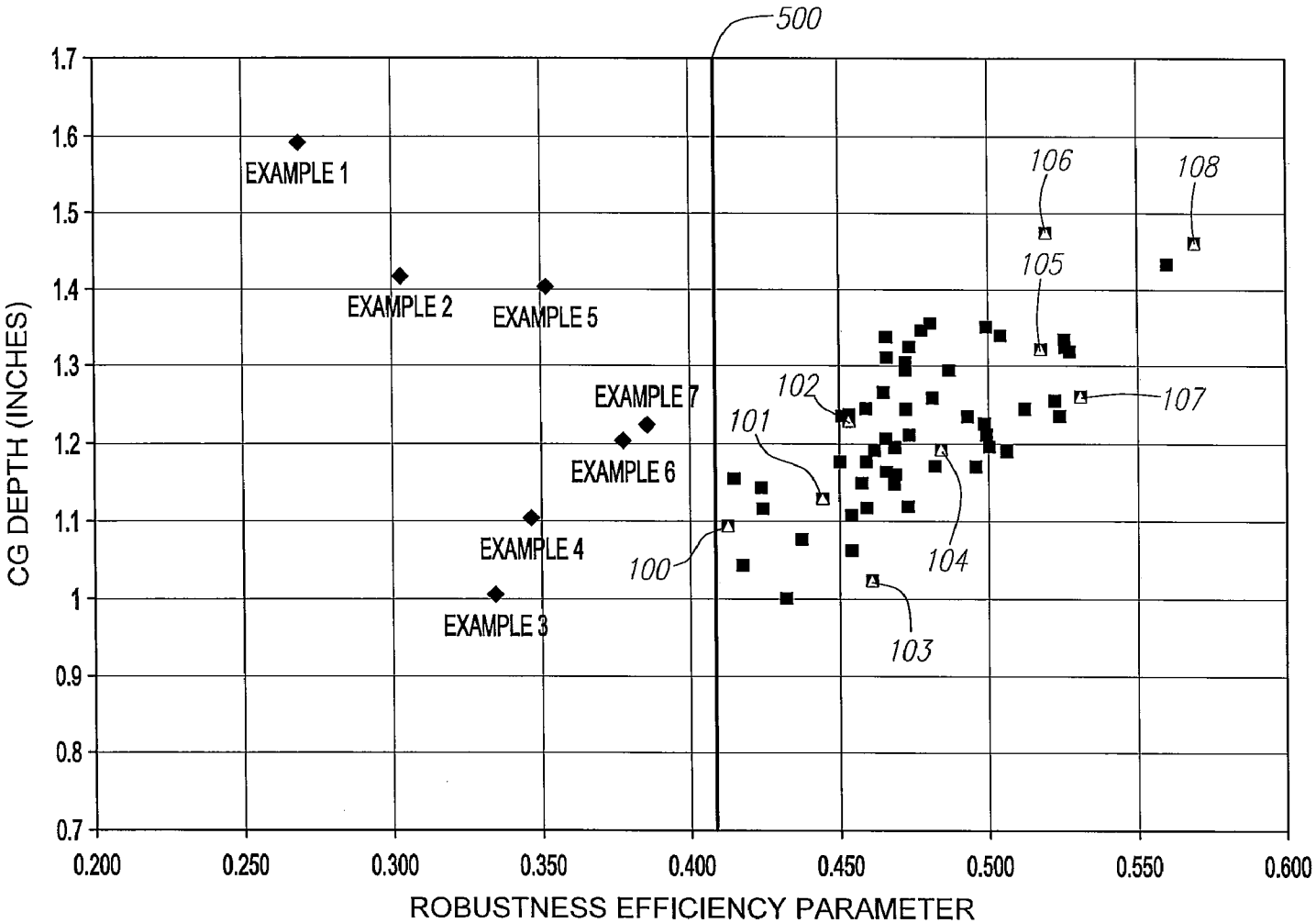
FIG. 19 is a graph of the robustness efficiency parameter versus center of gravity depth for a golf club head according to the present invention and for conventional golf club needs.

FIG. 19 is a graph of REP of a golf club head versus the distance of a center of gravity from the interior surface of a striking plate of a golf club head. The graph includes data points for the present invention, golf club heads provided in Table One, and conventional golf club heads, including those listen in Table Two. The line 500 represents the function Y=f(X)+b, which distinguishes golf club heads of present invention from other golf club heads.

The golf club heads of the present invention have a center of gravity located less than 1.7 inches from an exterior surface of the striking plate, and a robustness efficiency parameter of less than 0.41.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a body comprising a front wall, a sole and a ribbon, the body composed of a non-metallic material;

a crown plate attached to the ribbon and front wall of the body;

a weight piece disposed within a hollow interior formed by the body and crown plate, the weight piece comprising a striking plate insert attached to and supporting the front wall of the body, a first strip extending from a heel end of the striking plate insert to a toe end of the striking plate insert, and a second strip extending from a bottom of the striking plate insert toward a rear end of the body, the weight piece composed of a high density material having a density greater than the density of the material of the body;

wherein a center of gravity of the golf club head is located less than approximately 1.7 inches from an exterior surface of the front wall;

wherein the golf club head has a robustness efficiency parameter of less than approximately 0.410;

wherein the golf club head has a volume ranging from 300 cubic centimeters to 500 cubic centimeters;

wherein the golf club head has a moment of inertial Izz about the Z-axis through the center of gravity of greater than 3000 g-cm$^2$ and a moment of inertia Iyy about the Y-axis through the center of gravity in the range from 2000 g-cm$^2$ to 4000 g-cm$^2$.

2. The golf club head according to claim 1 wherein the body is composed of a material selected from the group consisting of polycarbonate, thermoplastic polyurethane, PBT (Polybutylene Terephthalate), blends of polycarbonate and polyurethane, carbon epoxy and plies of pre-preg.

3. The golf club head according to claim 1 wherein the weight piece is composed of a material selected from the group consisting of steel, titanium, a thermoplastic material filled with metal, and a film loaded with a high density material.

4. The golf club head according to claim 3 wherein the high density material for the film loaded with a high density material is selected from the group consisting of copper, tungsten, steel, aluminum, tin, silver, golf and platinum.

5. The golf club head according to claim 1 wherein the body is composed of a thermoplastic urethane material, the weight piece is composed of a steel material, the crown plate is composed of aluminum, and the golf club head has a robustness efficiency parameter of 0.346.

6. The golf club head according to claim 1 wherein the crown plate is composed of a material selected from the group consisting of aluminum, titanium and stainless steel.

7. The golf club head according to claim 1 further comprising a hosel positioned within the hollow interior formed by the body and crown plate.

8. A golf club head comprising:

a body comprising a front wall, a sole and a ribbon, the body composed of a non-metallic material;

a crown plate attached to the ribbon and front wall of the body, the crown plate composed of an aluminum material;

a weight piece disposed within a hollow interior formed by the body and crown plate, the weight piece comprising a striking plate insert attached to and supporting the front wall of the body, a first strip extending from a heel end of the striking plate insert to a toe end of the striking plate insert, and a second strip extending from a bottom of the striking plate insert toward a rear end of the body, the weight piece composed of a steel material;

wherein a center of gravity of the golf club head is located less than approximately 1.7 inches from an exterior surface of the front wall;

wherein the golf club head has a robustness efficiency parameter of less than approximately 0.410;

wherein the golf club head has a volume ranging from 300 cubic centimeters to 500 cubic centimeters;

wherein the golf club head has a moment of inertial Izz about the Z-axis through the center of gravity of greater than 3000 g-cm$^2$ and a moment of inertia Iyy about the Y-axis through the center of gravity in the range from 2000 g-cm$^2$ to 4000 g-cm$^2$.

9. A golf club head comprising:

a body comprising a front wall, a sole and a ribbon, the body composed of a thermoplastic urethane material;

a crown plate attached to the ribbon and front wall of the body, the crown plate composed of an aluminum material;

a weight piece disposed within a hollow interior formed by the body and crown plate, the weight piece comprising a striking plate insert attached to and supporting the front wall of the body, a first strip extending from a heel end of the striking plate insert to a toe end of the striking plate insert, and a second strip extending from a bottom of the striking plate insert toward a rear end of the body, the weight piece composed of a steel material;

a hosel positioned within the hollow interior formed by the body and crown plate, the hosel composed of an aluminum material;

wherein a center of gravity of the golf club head is located less than approximately 1.7 inches from an exterior surface of the front wall;

wherein the golf club head has a robustness efficiency parameter of less than approximately 0.410;

wherein the golf club head has a volume ranging from 300 cubic centimeters to 500 cubic centimeters;

wherein the golf club head has a moment of inertial Izz about the Z-axis through the center of gravity of greater than 3000 g-cm$^2$ and a moment of inertia Iyy about the Y-axis through the center of gravity in the range from 2000 g-cm$^2$ to 4000 g-cm$^2$.

* * * * *